US005217408A

United States Patent [19]

Kaine

[11] Patent Number: 5,217,408

[45] Date of Patent: Jun. 8, 1993

[54] PERSONAL PORTABLE EVAPORATIVE COOLER

[76] Inventor: Eugene Kaine, 5762 Sheryl Anita St., Oviedo, Fla. 32765

[21] Appl. No.: 762,454

[22] Filed: Sep. 19, 1991

[51] Int. Cl.[5] ..... F24F 7/007

[52] U.S. Cl. ..... 454/338; 62/259.3; 454/370

[58] Field of Search ..... 2/92, 210, DIG. 1; 62/259.3; 224/0.5, 153, 902; 454/338, 370

[56] References Cited

U.S. PATENT DOCUMENTS 2,304,367 12/1942 Meyer et al. ..... 224/902 X
2,826,758 3/1958 Kahn ..... 2/DIG. 1 X
3,096,702 7/1963 Malone, Sr. et al. ..... 454/370
3,113,320 12/1963 Cherowbrier et al. ..... 454/370 X
4,687,414 8/1987 Wardy ..... 224/153 X

*Primary Examiner*—Harold Joyce

[57] ABSTRACT

A personal portable evaporative cooling device comprising a cowling fitted to a person's back and spaced from said back to form a plenum into which ambient air is forced by an electric motor powered fan located in an opening in the cowling said opening located near the center of the cowling. The air exhausts through a gap between the periphery of the cowling and a person's back. The cowling is supported on said back by a harness. Electric power to the electric motor is provided by batteries carried on a waist band. Moisture is provided by perspiration.

11 Claims, 4 Drawing Sheets

PERSONAL PORTABLE EVAPORATIVE COOLER

BACKGROUND OF THE INVENTION

1. Field of the Invention

This invention relates to cooling devices, and in particular to portable personal cooling devices. In particular, portable personal cooling devices using air for ventilation and evaporative cooling.

2. Prior Art

The present invention relates to portable personal cooling in warm climates. Most approaches to portable personal cooling use a special garment in the form of a heat exchanger underwear such as in U.S. Pat. Nos. 3,425,486 to Burton, 3,425,487 to Tucker or 4,807,447 to MacDonald or a heat exchanger vest such as in U.S. Pat. Nos. 4,118,946 to Tubin, 4,691,762 to Elkins, and 4,856,294 to Scaringe, that have conduits for cooling fluids. The fluids must be cooled by machinery, ice or expanding gas. In the case of refrigeration machinery there is the added requirement for a power supply. With ice there is an ice reservoir containing a quantity of ice. With expanding gas there is required a gas tank, a quantity of gas and an expansion valve with a means of control. All of the components are of such a weight and bulk as to hinder casual movement and the complexity is expensive by comparison to the present invention.

SUMMARY OF THE PRESENT INVENTION

An object of the present invention is to provide a light weight inexpensive portable personal cooling device that allows a person to don it easily over any perspiration permeable garment or no garment and allows practical bodily movements while sitting, standing or walking, and that provides a means for dissipating body heat at a higher rate than is afforded by natural means. It is a further object of the present invention to provide a cowling that approximately conforms to the general contour of a back, and that the cowling is compliant so as to change the degree of curvature of said cowling in response to a back's normal articulation. According to the present invention, there is provided an electric motor driven fan to force air into a plenum formed by a body's back and a cowling spaced from the back. The purpose of the cowling is to guide the limited air flow available from a fan as the air flow diverges so that it flows at a higher velocity over more area of the back than can be realized with a fan and no cowling thus minimizing the size and weight of a fan and power source necessary for the cooling function. The air enters the plenum through an opening in the cowling and flows out at the periphery of the cowling. As the ambient air flows, it absorbs a body's heat. When the ambient air is lower in temperature than that of the body's back the air provides a cooling sensation. When a body's back provides perspirative moisture and the ambient air evaporates said moisture, a cooling sensation is provided at various ambient air temperatures that may be warmer than the body's skin. The electric motor and cowling are joined, and a harness attached to the cowling and motor assembly supports the assembly on a back while spacers attached to the inside surface of the cowling control the cross section of the plenum through which the air flows. The shoulder straps are connected to the side of the waist to minimize the slack in the shoulder strap that occurs when the back bends forward which could cause the cowling to ride up and down during repeated bending. The routing also avoids the area of the bosom on women as straps over the bosom are uncomfortable. Electric power is provided by an electric battery or plurality of electric batteries carried by a separate harness. The power supply having the densest and heaviest component of the system, is carried by the lower stronger part of the body on a waist band thereby making the weight on the shoulders (13 ounces more or less) via the shoulder straps minimal. An electrical connector is provided for easy connection and disconnection of the cooling device and electrical power supply.

BRIEF DESCRIPTION OF THE DRAWING

Turning to the drawings:

FIG. 1 shows the harnessing to the fan, the plenum formed by the back and the cowling, the air gap at the top and bottom and the separate waist band that carries the source of electrical power.

DESCRIPTION OF THE PREFERRED EMBODIMENT

Figure 1:
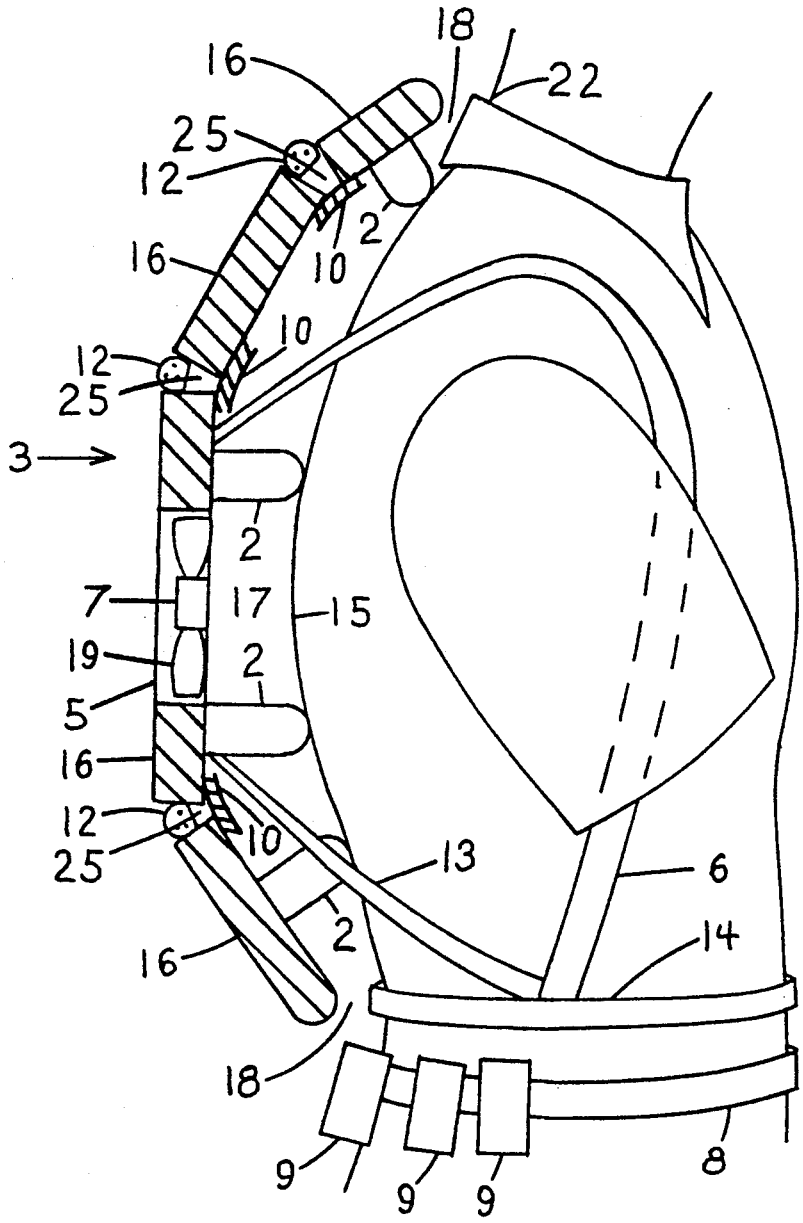
FIG. 1 is a cross section of the cowling taken through section 1—1 of FIG. 3 of the cowling.
Figure 2:
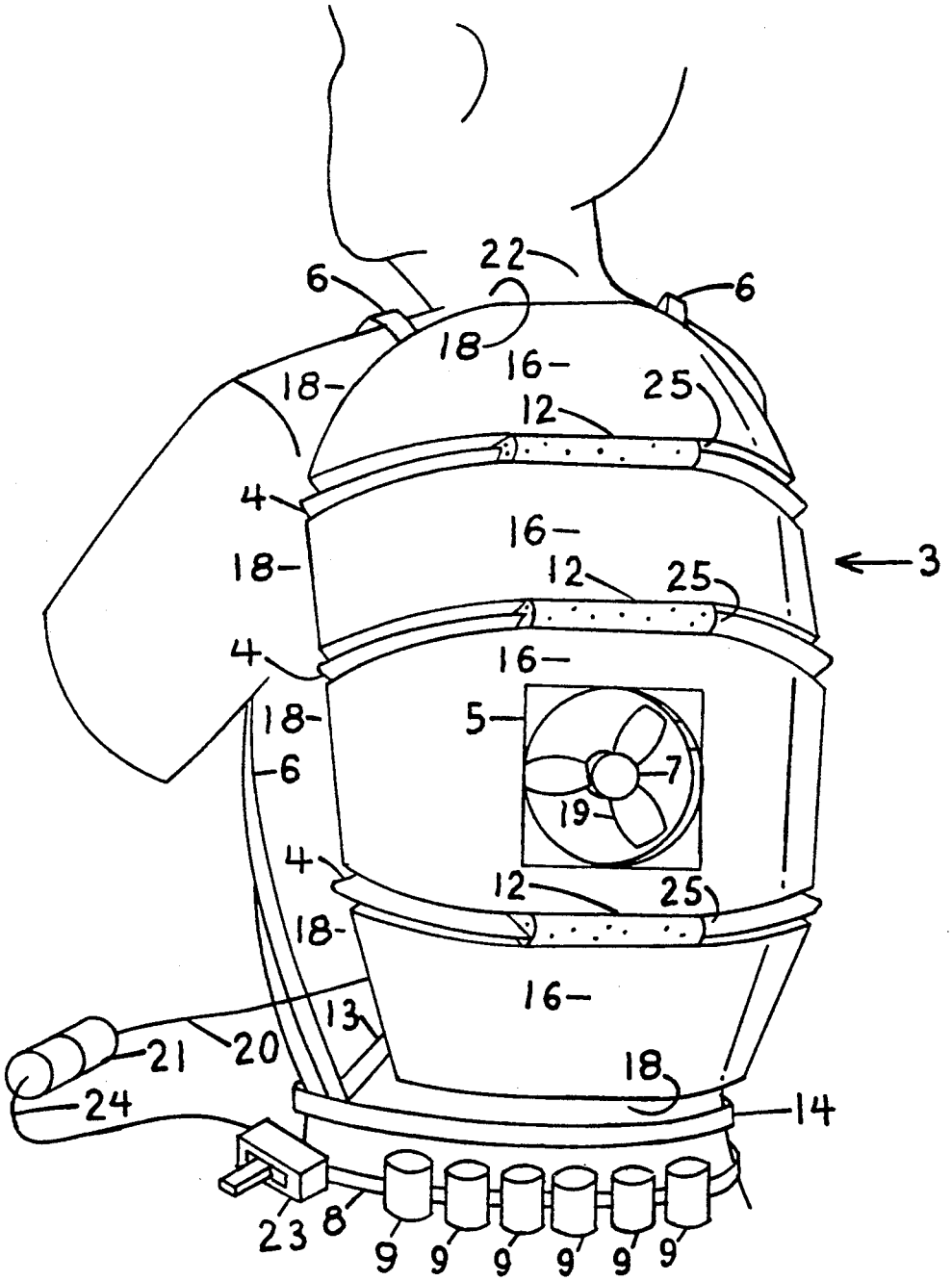
FIG. 2 illustrates a person wearing the personal portable evaporative cooler showing a cowling, location of air gaps along the side, supporting straps, fan and separate waist band carrying electrical batteries.
Figure 3:
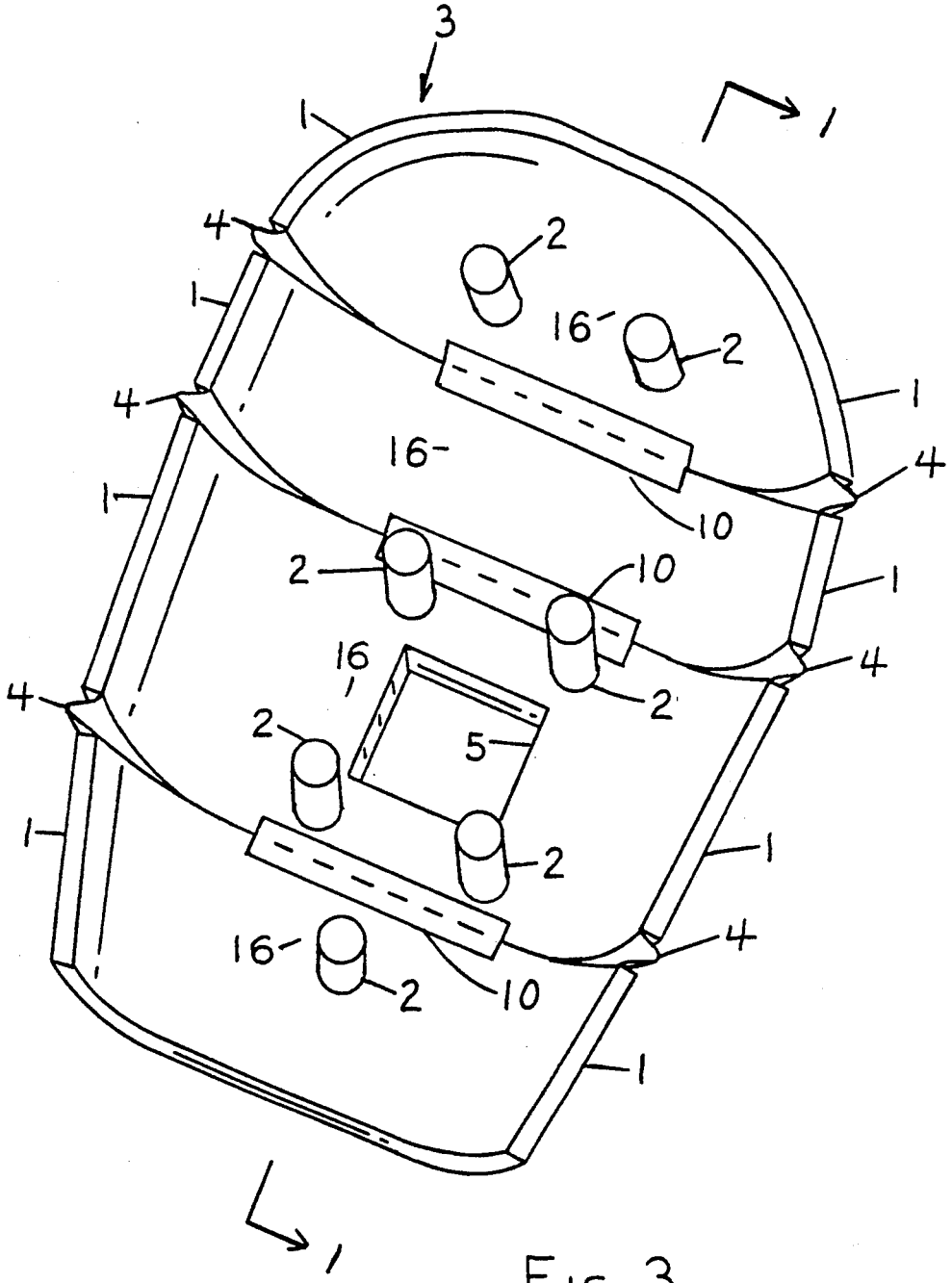
FIG. 3 is a perspective view of the cowling showing spacers, hinges, flaps and membranes.
Figure 4:
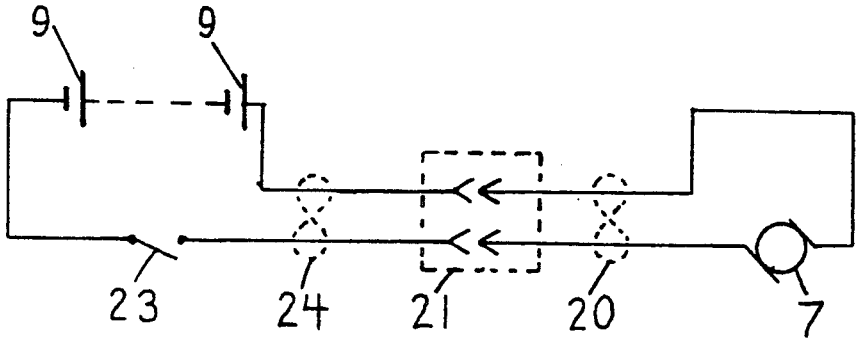
FIG. 4 is an electrical schematic wiring diagram of the power supply, connector, switch and electric motor.

Refer now to FIG. 1. The cowling 3 shaped to rest on a set of spacers 2 that are attached on the inside of the cowling 3. The other end of the spacers 2 rest against a body's back 15 to space the cowling from the back. The cowling 3 supported thereon by a set of shoulder straps 6, lumbar straps 13, and a waist strap 14 forms a plenum 17 between the cowling 3 and said back 15. Shoulder straps 6 are attached to the motor 7 and cowling 3 attachment at the top of the motor 7 and pass over the shoulders and attach to the waist strap 14 at the side. Said shoulder straps 6 support the cowling 3 between the small of the back 15 and the nape of the neck 22. Lumbar straps 13 which are fastened to the cowling 3 pass from the bottom of the motor 7 and cowling 3 attachments downward and outward and fasten to the waist strap 14 at the side so as to hold the cowling 3 centered laterally and against the back 15 spaced from the back 15 by the spacers 2. Refer now to FIG. 1 and FIG. 3. The cowling is shaped so that the cowling 3 held against said back 15 has an air gap 18 around the periphery of the cowling 3 to provide a means for air to flow out of the plenum 17. Refer now to FIG. 2 and FIG. 3. The plenum 17 receives outside air through an opening 5 at or near the middle of the cowling 3. Means to force air into the plenum is provided by an electric motor 7 mounted in said opening powering a fan 19. A source of electrical power is provided by a battery power supply comprising a battery 9 or plurality of batteries 9 removably secured to a separate waist band 8. Refer to FIGS. 2 and 4. A power supply 9 to motor 7 interconnection is made by wires 20 and wires 24 terminating in electrical connector 21. Power is turned on and off by a manually operated electrical switch 23. Refer now to FIG. 3. The cowling 3 is made of light weight material such as foamed plastic in several hinged 10 segments 16. Each segment 16 has a curve on each end formed by flaps 1. The segments 16 and the flaps 1 of each segment 16 conform approximate to the lateral curvature of the body's back 15 because of the hinging 10 of the segments 16 and lateral curvature of the segments 16 of the cowling 3 which approximately conforms to the general contour of a back 15. The flaps 1 leave a gap between the cowling and the back 15 of lesser spacing than the spacing allowed by the spacers 2 so as to speed up the air as the air exhausts from the plenum 17. The cowling 3 is compliant so as to change the degree of curvature of the cowling 3 in response to a back's 15 articulation by the use of hinges 10 made of flexible material such as cloth which allows the segments 16 to articulate with a body's back 15 as the back 15 bends. Refer now to FIG. 1 and FIG. 3. Spongy material 12 is attached in the jambs 25 of the hinges 10 to make the hinged segments spring toward the back 15 as the back 15 bends and unbends. Refer now to FIG. 2 and FIG. 3. The gaps between adjacent flaps 1 are closed by flexible membranes 4 such as film or cloth which allow the segments to articulate but keep the air flow close to the body.

In another embodiment, reversing the direction of the fan 19 causes outside air to flow into the plenum 17 through the air gap 18 which forces air to flow through the plenum in the opposite direction. The air is forced out of the plenum 17 through the opening 5.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A personal portable evaporative cooling device comprising:

(a) a cowling shaped to approximately conform to the general contour of the back of a body and said cowling having flexible means to change the degree of curvature of said cowling in response to said back's articulation, a set of spacers attached at one end inside of said cowling and the other end of said spacers rest against the back to space the cowling from the back and to form a plenum between said cowling and said back;

(b) means of support for said cowling on the back;

(c) an opening near the middle of said cowling, and in which opening is fastened means to force air to flow through said plenum; and (d) said cowling being shaped and spaced from said back so that said cowling having along said cowling's periphery means for said air to flow.

2. The device of claim 1 wherein the means to force air into said plenum being an electric motor which drives a fan.

3. The device of claim 2 wherein a source of electrical power for said electric motor being a battery power supply comprising a battery or plurality of batteries being removably secured to a separate waist band.

4. The device of claim 3 wherein power supply interconnection and disconnection is made by wires terminating in electrical connectors.

5. The device of claim 3 wherein power is turned on and off by a manually operated electrical switch.

6. The device of claim 1 wherein said flexible means being said cowling is made of a plurality of segments hinged so that they can articulate with a body's back.

7. The device of claim 6 wherein the segments being curved to make the segments to form approximate the lateral curvature of the body's back.

8. The device of claim 6 wherein means is provided for said hinged segments to spring toward said back.

9. The device of claim 6 wherein the ends of each segment having inwardly depending flaps whereby gaps between adjacent flaps are formed, said gaps being closed by flexible membranes.

10. The device of claim 8 wherein spongy material is put in the jamb of the hinge to make the segments spring toward said back.

11. The device of claim 1 wherein means to support said cowling comprising:

(a) a waist band;

(b) shoulder straps fastened to said cowling and fastened to said waist band; and (c) lumbar straps fastened to the cowling and fastened to said waist band.

* * * * *